United States Patent [19]

Johnson

[11] 4,226,473

[45] Oct. 7, 1980

[54] RECLINING CHAIR

[75] Inventor: Carl B. Johnson, Pontiac, Ill.

[73] Assignee: Pontiac Furniture Industries, Inc., Pontiac, Ill.

[21] Appl. No.: 885,586

[22] Filed: Mar. 13, 1978

[51] Int. Cl.[2] ..... A47C 1/02

[52] U.S. Cl. ..... 297/316; 297/68; 297/83; 297/321

[58] Field of Search ..... 297/83, 342, 340, 341, 297/322, 316, 68, 320, 319, 321; 5/37 R

[56] References Cited

U.S. PATENT DOCUMENTS

| | | | |
|---|---|---|---|
| 1,204,785 | 11/1916 | Kindel | 297/341 |
| 2,028,633 | 1/1936 | Thomas | 297/322 |
| 2,730,164 | 1/1956 | Highley et al. | 297/321 |
| 3,059,969 | 10/1962 | Schliephacke | 297/321 |
| 3,065,025 | 11/1962 | Schliephacke | 297/89 |
| 3,139,305 | 6/1964 | Mizelle | 297/317 |
| 3,163,464 | 12/1964 | Martin et al. | 297/85 |
| 3,198,576 | 8/1965 | Rosmarin | 297/342 |
| 3,337,267 | 8/1967 | Rogers, Jr. | 297/322 |
| 3,341,249 | 9/1967 | Fletcher | 297/85 |
| 3,433,527 | 3/1969 | Re' | 297/83 |
| 3,475,051 | 10/1969 | Crawford | 297/69 |
| 3,869,172 | 4/1975 | James et al. | 297/316 |
| 3,947,067 | 9/1976 | Griefahn | 297/316 |

FOREIGN PATENT DOCUMENTS

| | | | |
|---|---|---|---|
| 691437 | 5/1940 | Fed. Rep. of Germany | 297/322 |
| 368280 | 5/1963 | Switzerland | 5/37 R |

*Primary Examiner*—James T. McCall

*Attorney, Agent, or Firm*—Fitch, Even, Tabin, Flannery & Welsh

[57] ABSTRACT

A reclining chair is disclosed in which the seat is movably supported on the base of the chair at each side by a pair of links which are inclined upwardly and rearwardly from the base to the seat, and the forward link is longer than the rearward link so as to increase the pitch of the seat as the seat is raised and moves forward.

The backrest is pivoted to the seat well above the plane of the seat frame, and is supported by an upstanding link pivoted to the base. The backrest, in reclining, pivots on the upper end of the upstanding link as a fulcrum, and raises the seat.

The elevation of the seat is guided by its supporting links, which move the seat forward, with the lower end of the backrest following, as the seat is lifted.

3 Claims, 2 Drawing Figures

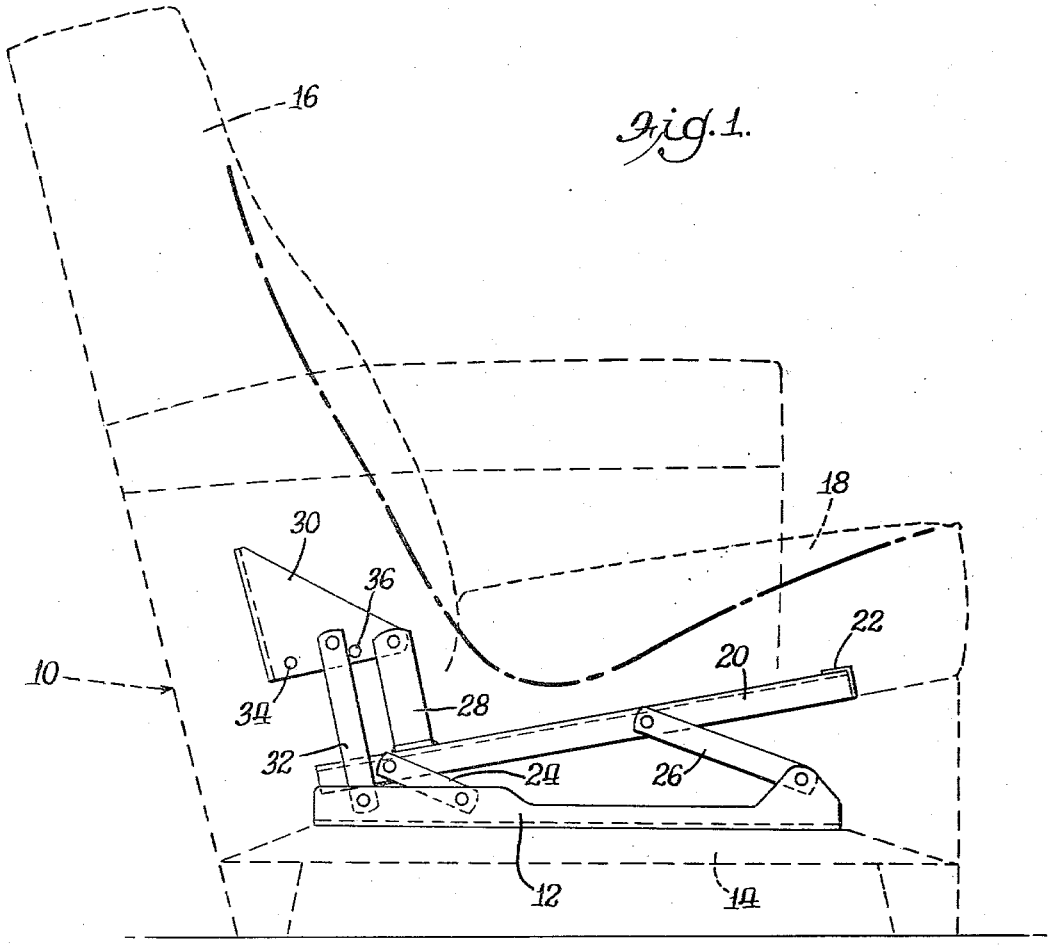
Fig. 1.
Fig. 2.
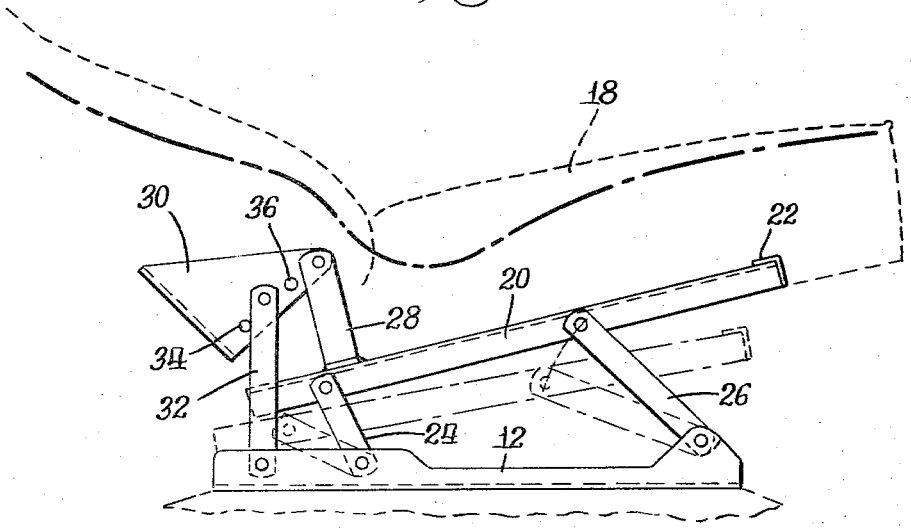

RECLINING CHAIR

This invention relates to reclining chairs and particularly to a linkage mechanism for interconnecting the backrest and the seat of such a chair for coordinated movement relative to the base or sub-base upon which they are supported.

In the accompanying drawings, the linkage mechanism is illustrated in its simplest kind of application, i.e., in which the backrest and the seat of the chair are both movable relative to a normally-stationary base, without more. In this kind of application, the chair would usually be accompanied by a separate ottoman upon which the occupant's legs could be supported when the chair is in the reclined position.

The linkage mechanism which forms the subject matter of the invention is equally applicable to the more elaborate kind of reclining chairs now in vogue, i.e., which incorporate a self-contained extensible footrest in lieu of separate ottoman, and which may also be combination rocker-recliners, or, more recently, wall-clearing recliners, i.e., a reclining chair which is movable forwardly upon its base to provide clearance behind the chair for reclining the backrest without striking the wall behind the chair.

As one illustration of such application, the linkage mechanism of this invention is incorporated in a wall-clearing recliner in the disclosure of my companion, co-pending Application Ser. No. 885,585, filed contemporaneously herewith.

The subject reclining mechanism may be further appropriately characterized as an improvement of the reclining mechanism of a generally similar character which is illustrated and claimed in U.S. Pat. No. 3,869,172, issued Mar. 4, 1975 for my prior invention jointly with Henry James. The linkage of the present invention is an improvement over that of U.S. Pat. No. 3,869,172 in the sense that while it performs essentially the same functions and displays essentially the same advantages, it achieves them with a smaller number of operating parts. That is to say, the mechanism herein disclosed displays good balance throughout the range of the adjustment of the chair without undue acceleration during movement to and from the reclining position, and in its ability to maintain the lower end of the backrest in close proximity to the rear end of the chair seat so as not to be a "shirt-tail puller".

The specifics will be readily understood from the accompanying drawings, in which FIG. 1 is a side elevation of a reclining chair incorporating the linkage mechanism of the invention, in which the outline of the chair and its respective parts are represented in dotted outlines, and on which a typical bodydepression outline is superimposed to indicate the outline of the supporting surfaces when the chair is sat in; and FIG. 2 is a similar elevational view in which the mechanism is shown in the position of full recline, the supporting surfaces of the backrest and seat again shown in dotted outline, with a body-depression outline superimposed, but with the overall outline of the chair omitted as unnecessary.

Referring to FIG. 1, it will be understood by those skilled in the art that the linkage mechanism as there illustrated is incorporated into the near side of the chair 10, and is duplicated on the far side by a linkage which is essentially a mirror-image of the one illustrated. Each, therefore, comprises a base member 12 which is secured to the normally stationary base of the chair by any suitable means such as screws, inasmuch as the typical structural framing of the chair components, i.e., the chair base 14, the backrest 16, and, in part, the seat 18, are made of wood or plastic. The base member is preferably angle-shaped in cross-section to provide a horizontal flange to transmit the occupant's weight to the stationary frame, and a vertical flange to which other members of the linkage are attached.

Above the attaching base member 12 is the side rail of the seat frame 20, which is likewise of angle iron and connected to its corresponding member on the far side of the chair by a front rail 22, and by any suitable cross member at the back of the chair to form, in plan, a rectangular frame. In the sitting position of the chair, the base member 12 is assumed to be essentially horizontal and the side rail 20 of the seat frame pitched upwardly from back to front at a comfortable angle adequate to prevent forward shifting of the occupant on the chair seat 18.

The side rail of the seat frame 20 is supported by a pair of links 24 and 26 each pivoted to the seat frame and to the base member, and each inclined upwardly and rearwardly from its pivotal connection to the base member to its pivotal connection to the side rail of the seat frame. The front seat support-link 26 is considerably longer than the rear link 24, and both are inclined at a very substantial angle from the vertical in order to impart a substantial upward as well as forward movement to the seat frame 20 as the chair is reclined.

Secured to the seat frame 20 as by welding to the side rail thereof is an upstanding bracket 28 to which the backrest mounting plate 30 is pivoted. The other remaining support for the backrest is provided by upstanding jacking link 32 which is pivoted at its upper end to the backrest mounting plate 30 and at its lower end to the base member 12.

The backrest support link 32 serves as a jacking strut, i.e., it provides at its upper end a shiftable fulcrum for the backrest mounting plate 30 so that the backrest, responding as a lever to the rearward pressure exerted by the occupant's shoulders, lifts the seat frame 20. The seat frame, however, is confined to a fixed path of movement relative to the base member 12 by the two supporting links 24 and 26 with which it forms a four-bar linkage.

Therefore, as the seat frame 20 is lifted by the recline of the backrest 16, the seat frame 20 carries the backrest mounting plate 30 simultaneously forwardly in a shifting movement which is permitted by its movable connection to the base through the link 32.

The respective seating and reclining positions are determined by limit stops in the form of the shoulder rivets 34 and 36 secured to the backrest mounting plate 30 and engageable with the backrest support link 32 to determine the two limit positions of the chair.

The overslung support of the seat provided by the two links 24 and 26 elevates the seat rapidly during even the initial recline of the backrest, with the longer front link 26 serving simultaneously to increase the pitch angle of the seat as the backrest reclines. At the same time, however, both seat and backrest shift forwardly upon the supporting base member 12, the backrest 16 because of its pivotal connection to the seat frame bracket 28 well above the plane of the seat frame 20, maintaining its forward pressure on the small of the occupant's back, and preventing the separation which produces the undesirable "shirt-tail pulling" action frequently associated with reclining chairs.

The rearward rotation of the backrest into the reclining position under the pressure of the occupant's shoulders is resisted sufficiently by the portion of the occupant's weight exerted on the seat to maintain adequate control of the rearward acceleration of the rearward reclining movement, and to maintain adequate balance in all positions of recline. Conversely, the upward and rearward inclination of the seat-supporting links 24 and 26 in all attainable positions applies the occupant's weight to restore the chair to sitting position when the occupant sits up. This result, with all of the desired movement of the backrest relative to the seat and of both those members relative to the base, is achieved with fewer parts than were minimally required in the mechanism of our U.S. Pat. No. 3,869,172 designed for the same purpose.

The features of this improved linkage believed patentable are set forth in the accompanying claims:

What is claimed is:

1. In a reclining chair having a base, a seat, a backrest, and linkage means at each side of the chair interconnecting said backrest and seat and mounting the same on said base for movement relative thereto and to each other from a sitting position to a reclining position, the improvement wherein said linkage means includes a pair of seat-supporting links each pivoted to the base and to the seat on centers spaced from front to rear thereon to constitute therewith a four-bar linkage in which said links are inclined upwardly and rearwardly from the base to the seat in said sitting position, the backrest being pivoted to the seat, and said linkage means including a third link pivoted to the base and extending upwardly therefrom to a pivotal connection to the backrest spaced rearwardly from the pivotal connection of the backrest to the seat when the chair is in sitting position, the pivotal connection of the backrest to said third link constituting a shiftable fulcrum enabling the backrest upon recline to lift the seat, and to follow the seat forwardly of the base as the seat is lifted by the rearward rotation of the backrest into said reclining position, the said upward and rearward inclination of the seat-supporting links being maintained in all positions of the chair between said sitting and reclining positions so as to effect the return of the chair to the sitting position by the weight of the occupant as the occupant sits up to remove the force of his back against the backrest.

2. The improvement of claim 1 wherein the seat includes a frame having secured thereto an upstanding bracket near the rear thereof, and the pivotal connection of the backrest to the seat is made to said bracket at a point disposed above the frame of the seat to permit the front surface of the lower end of the backrest to swing forwardly and upwardly relative to the seat to support the occupant firmly in the small of the back in said reclining position.

3. The improvement of claim 1 wherein the length of the forward one of said pair of seat-supporting links of each linkage is greater than that of the rearward one of the pair, and the respective inclinations thereof with respect to said base are such as to increase the pitch of the seat as it moves forwardly by the movement of the chair into reclining position.

* * * * *